United States Patent [19]

Cranor

[11] 4,046,327

[45] Sept. 6, 1977

[54] RELEASABLE LOCK

[75] Inventor: Dennis A. Cranor, Milwaukie, Oreg.

[73] Assignee: ESCO Corporation, Portland, Oreg.

[21] Appl. No.: 668,478

[22] Filed: Mar. 19, 1976

[51] Int. Cl.[2] ..... B02C 13/28

[52] U.S. Cl. ..... 241/197

[58] Field of Search ..... 241/195, 197, 300

[56] References Cited

U.S. PATENT DOCUMENTS

| | | | |
|---|---|---|---|
| 2,186,047 | 1/1940 | Stine | 241/197 |
| 3,022,018 | 2/1962 | Knight | 241/197 |
| 3,367,585 | 2/1968 | Ratkowski | 241/300 X |
| 3,510,076 | 5/1960 | Perdue | 241/197 |
| 3,917,179 | 11/1975 | Graf | 241/195 X |

FOREIGN PATENT DOCUMENTS

| | | | |
|---|---|---|---|
| 671,397 | 2/1939 | Germany | 241/197 |

*Primary Examiner*—Roy Lake
*Assistant Examiner*—Howard N. Goldberg
*Attorney, Agent, or Firm*—Tilton, Fallon, Lungmus, Chestnut & Hill

[57] ABSTRACT

A releasable lock for a wearable device such as a hammer tooth or chain shackle in which two parts of the device are held together by means of a pin, the pin further being immobilized by a deformable rivet, the rivet extending through a transverse bore in the pin.

4 Claims, 12 Drawing Figures

RELEASABLE LOCK

BACKGROUND AND SUMMARY OF INVENTION

This invention relates to a locking device and, more particularly, to a releasable lock useful in connection with hammers, teeth, chain shackles, etc. Such devides encounter severe wear because of contact with the material being worked, i.e., rock, gravel, ground, kiln material, etc., and thus are subject to accelerated wear particularly in the work engaging surfaces. This has led, over the years, to the provision of two-part devices — the part encountering the work being replaceable, i.e., hammer, point, chain shackle, etc. Thus, it is essential that the means securing the two parts together be readily removed — otherwise a valuable piece of equipment may be out of operation for a substantial time.

On the other hand, inasmuch as the work is arduous, it is also essential that the parts be secured together in a rugged, reliable fashion. This has led to the development of a wide variety of different releasable locks.

For example, in the hammer area, as illustrated by co-owned U.S. Pat. No. 3,510,076, a locking pin extended through aligned passages in the two parts, the pin being further immobilized by locking rings at the two ends thereof. In certain instances under harsh working conditions, the rings have failed or otherwise deteriorated so that their stabilizing function, relative to the locking pin, was lost and the parts become inadvertently detached. Depending upon the environment, a detached part could not only be costly in terms of permitting wear of a part not intended to be contacted by the work but actually dangerous to people in the vacinity if the part become detached under conditions where it could fly off of its holder.

The releasable lock of the present invention avoids these drawbacks and reconciles the twin goals of ready releasability while providing a reliable attachment through the use of a deformable rivet extending through a diametral bore in the locking pin securing the two parts together. As such, the inventive arrangement provides substantial advantages over prior approaches employing bore-equipped pins such as U.S. Pat. No. 2,186,047 and 3,022,018.

Other objects and advantages of the invention may be seen in the details of the ensuing specification.

DETAILED DESCRIPTION

The invention is described in conjunction with an illustrative embodiment in the accompanying drawing, in which FIG. 1 is a perspective view of an impact device with the releasable lock elements positioned adjacent thereto prior to installation;

Figure 1:
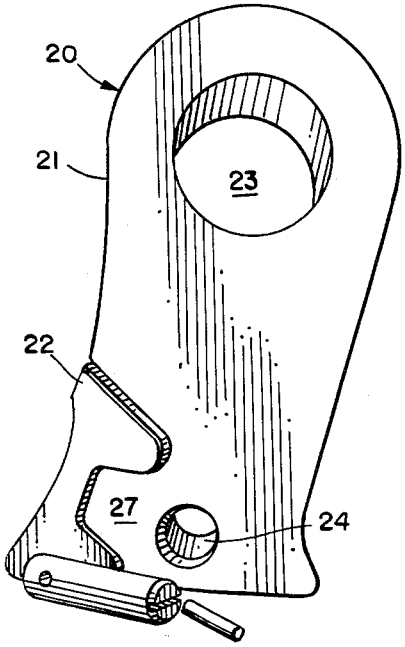

In the illustration given and with reference to FIG. 1, the numeral 20 designates generally an impact device which, as illustrated herein, is an impact hammer. As indicated previously, the invention releasable lock has advantageous application to other types of devices such as trencher teeth, kiln chain shackles, and the like. Characteristic of these devices is the provision of a first part 21 such as a holder or shank and a second wearable part 22 such as a hammer, tip, chain link, etc.

Figure 2:
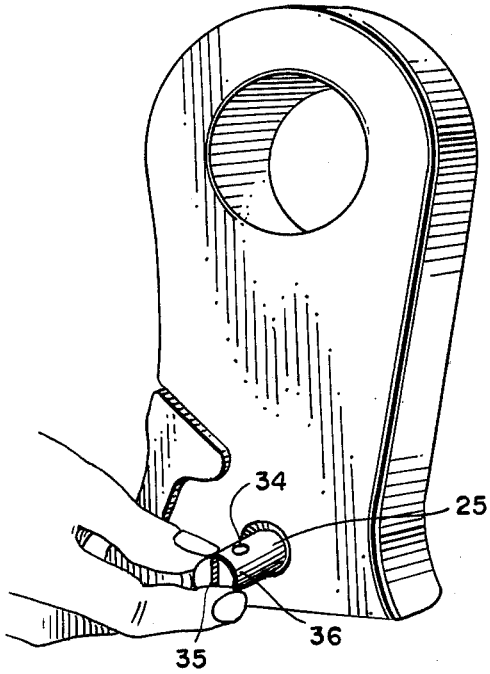
FIG. 2 is a view similar to FIG. 1 but with the pin being shown in the process of installation.
Figure 6:
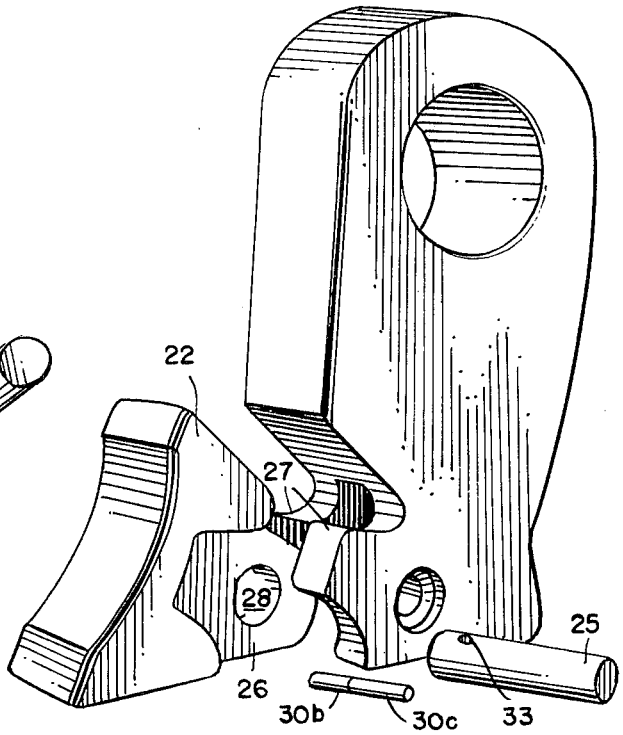
FIG. 6 is a perspective exploded view of the various parts and elements of the disassembled device.
Figure 9:
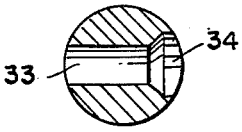
FIG. 9 is a sectional view taken along the line 9—9 applied to FIG. 7.

Insofar as the specific illustration of FIG. 1 is concerned, the shank is equipped with an opening 23 for mounting on a pivot shaft (not shown) but in a fashion known to the art. Spaced longitudinally from the opening 23 is a through passage 24 in the shank part 21 which is intended to receive a locking pin 25 in the fashion illustrated in FIG. 2. The tip part 22, as illustrated, is equipped with a rearwardly extending tang 26 (see FIG. 6) which extends between the tongues 27 provided at the lower part of the shank part 21. The tang 26 is equipped with a through passage 28 (still referring to FIG. 6) which is aligned with the through passage 24 in the two tongues 27 as illustrated in FIG. 1.

Figure 3:
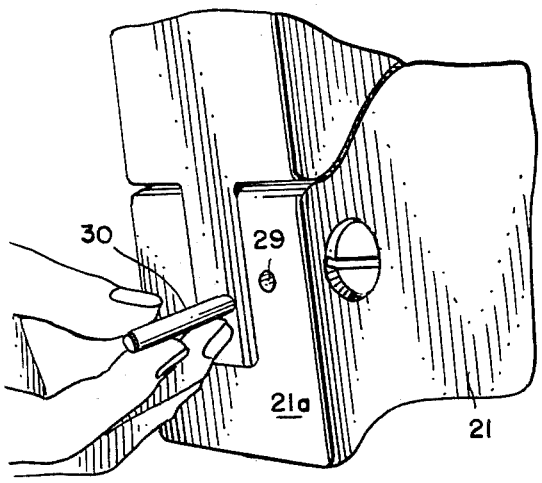
FIG. 3 is a perspective view of the bottom of the impact device showing the deformable rivet in the process of being inserted.
Figure 11:
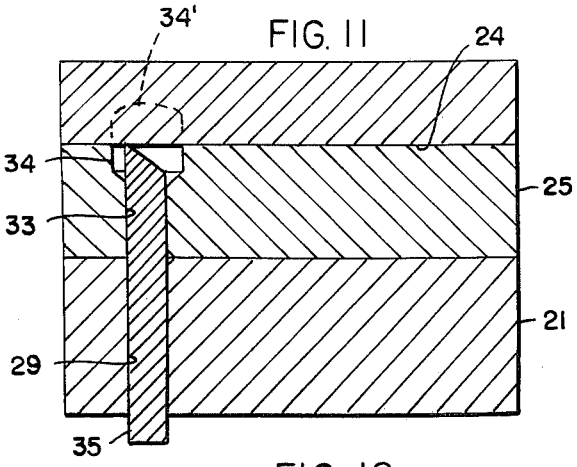
FIG. 11 is an enlarged sectional view of the interior of the device showing the rivet in the process of installation.
Figure 7:
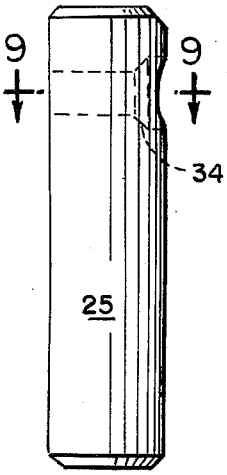
FIG. 7 is a side elevational view of the locking pin illustrated in the preceeding views.
Figure 8:
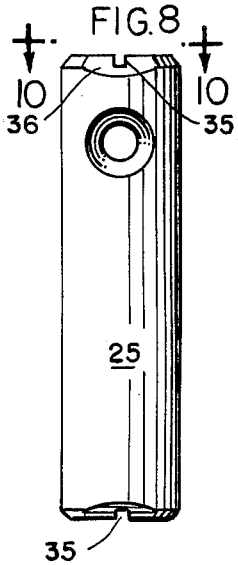
FIG. 8 is another elevation view of the locking pin (but take at 90°) to the showing in FIG. 7.

Referring now to FIG. 3, the bottom **21*a* of the shank part 21 is equipped with a longitudinally extending bore 29 (see also FIG. 11). Referring again to FIG. 3, a rivet 30 is seen positioned for insertion within the bore 29. Advantageously, the rivet is deformable, being constructed of a mild steel. Thus, when the end of the rivet in 30 is hit with a hammer as at 31 in FIG. 4, the inner end of the rivet 30 becomes deformed as at 30*a* (see FIG. 12). This provides positive lock restraining the pin 25 against axial movement and therefore inadvertent disassembly of the parts, i.e., detachment of the hammer part 22 from the shank part 21**.

Figure 12:
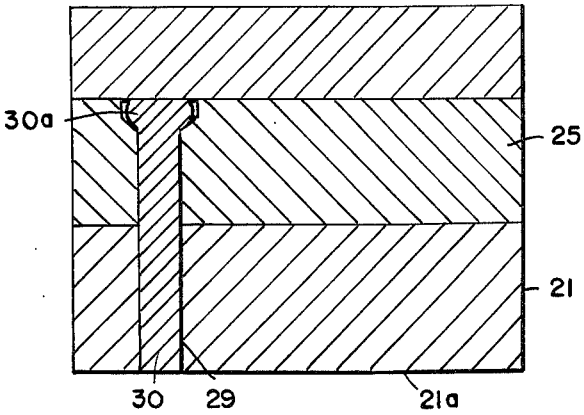
FIG. 12 is a view similar to FIG. 11 but showing the rivet in deformed condition.

As can be appreciated from FIG. 12, the lock (made up of the pin 25 and rivet 30 are completely protected from wear — the rivet being driven into the bores 29 and 33 (during deformation) so as to become flush with the surface **21*a* of the part 21**.

Figure 5:
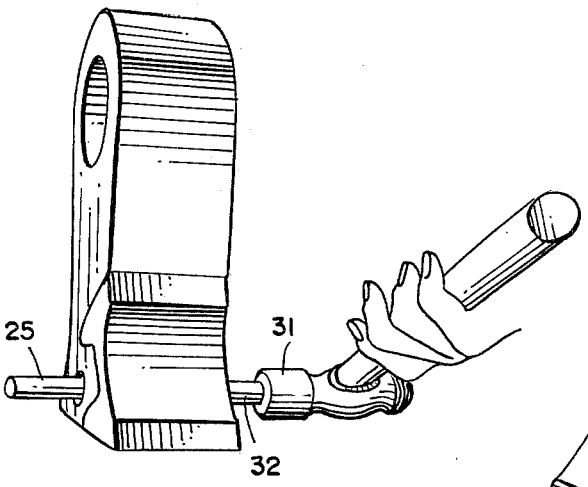
FIG. 5 is an end perspective view showing the pin in the process of being removed so as to disassemble the impact device.

When it is necessary or desirable to disassemble the two parts — as for replacement of a worn hammer part 22, all that required is to apply a sharp axial force against the pin 25. This is illustrated in FIG. 5 where a hammer 31 engages the end of a drift pin 32 for knocking the pin 25 out of the aligned through passages 24 and 26. Inasmuch as the rivet 30 is immobilized against removal, this results in fracture of the rivet into two parts as illustrated in the lower part of FIG. 6 as at **30*b* and 30*c*. Thus, the relatively more expensive hardened steel pin 25 can be reusable but the inexpensive rivet 30** has but a one time use.

Reference is now made to FIGS. 7–10 which illustrate certain details of the pin 25 and which are advantageous in insuring quick and proper installation thereof. The pin 25 is seen to be equipped with a transverse or diametral bore 33 which is alignable with the bore 29 for the receipt of the rivet 30 — see also FIG. 11. The bore 33 is advantageously equipped with a counter bore or enlargement 34 at one end thereof for accommodating the peened or deformed end of the rivet 30.

Figure 10:
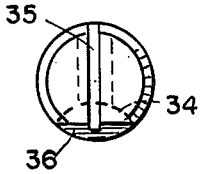
FIG. 10 is an end elevational view such as would be seen along the line 10—10 of FIG. 8.

For the purpose of quickly and reliably aligning the pin 25 within the through passage 24 — so as to have the bores 29 and 33 in alignment, each end of the pin 25 is equipped with a slot or groove as at 35, and which extends parallel with the bore 33 (see FIG. 10).

The ends of the pin 25 are equipped with chamfers or bevels as at 36 for indicating the position of the counter bore 34 (see particularly FIG. 10). Thus, the artisan assemblying the releasable lock can immediately position the pin within the aligned through passages 24 and 26 so that the bores 33 and 29 are aligned and further that the counterbore 34 is on the side of the pin 25 remote from the bore 29.

The advantages of the inventive arrangement can also be realized through the provision of a counter bore 34' communicating with the through passage 24 (see FIG. 11). This would allow the eliminating of the counter bore 34 in the pin 25 and which may be advantageous where it is easier or more structurally advantageous to have the counter bore in the mounting part rather than the locking pin. The rivet 30 is also advantageously equipped with a bevel or reduced diameter at the inner end thereof so as to facilitate the deformation illustrated at 30*a* in FIG. 12. Alternatively, ready deformation can be achieved by heating the end of the rivet 30 just prior to installation.

Figure 4:
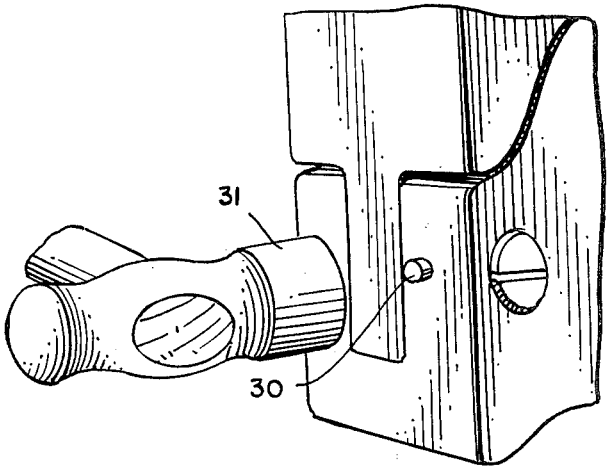
FIG. 4 is a view similar to FIG. 3 illustrating the step of deforming the rivet.

It will be appreciated that for the ease of installation illustrated in FIGS. 3 and 4, the rivet 30 should have an overall length somewhat greater than the combined lengths of the bores 33 and 29 — thereby avoiding the need for using a smaller drift pin, dowel, punch, etc. The rivet 30 is advantageously more ductile than the pin 25 in the illustration given — being constructed of mild steel, i.e., low alloy steel having a carbon content less than about 0.024%. However, other materials of construction may be used for the rivet 30 — only that the rivet shear preferentially when an axial force is applied to the pin 25. The destruction of the rivet 30 also provides an advantage — no rivet is reused which may have been stressed in a prior installation so as to fail prematurely or unexpectedly.

For a ¾ inch diameter pin 25, the rivet 30 is advantageously of the order of ¼ inch in diameter and with the maximum diameter of the counter bore 34 being slightly less than ½ inch. With this arrangement, about nine times the retaining power of the spring ring and grooved pin of U.S. Pat. No. 3,510,076 is achieved.

Through the provision of the deformable rivet, inserted through the aligned bores 29 and 33, it is possible to achieve a releasable lock for the two parts of the wearable device utilizing only hammer strokes to achieve both installation and disassembly. Further, all that is exposed during use are the ends of the pin 25 and one end of the rivet 30. In contrast to prior locks, caking does not adversely affect the operation or disassembly of the inventive lock.

I claim:

1. A releasable lock for securing together two parts of a wearable device comprising first and second parts, aligned through passages in said parts for receiving a locking pin, a pin in said passages maintaining said parts in coupled relation, one of said parts being equipped with an exterior surface, a bore in said one part communicating with said exterior surface and extending inwardly therefrom transversely to and communicating with the passage in said one part, said pin having a transverse bore alignable with said one part bore when said pin is maintaining said parts in coupled relation, and a ductile, elongated rivet mounted in said bores having inner and outer ends, the inner end of said rivet being the end first introduced into said bores, one of said pin and said one part being equipped with a counter bore receiving said rivet inner end and adapted to accommodate deformation of said rivet inner end resulting from force applied to said outer end, said rivet being more ductile than said pin whereby an axial force applied to said pin preferentially shears said rivet, said rivet prior to deformation having a length greater than the sum of the lengths of said bores whereby said rivet outer end, prior to inner end deformation, protrudes outwardly of said exterior surface.

2. The structure of claim 1 in which said rivet has a reduced diameter at one end thereof.

3. The structure of claim 1 in which said pin is equipped with alignment indicia on the ends thereof.

4. The structure of claim 1 in which said one part is a hammer shank, the other of said parts being a hammer tip, said shank being elongated and having a mounting opening adjacent one end thereof, the other end including a generally flat surface extending transversely of the length of said shank and constituting said exterior surface. /

* * * * *